United States Patent [19]

Tanaka

[11] Patent Number: 5,059,929

[45] Date of Patent: Oct. 22, 1991

[54] DIELECTRIC RESONATOR

[75] Inventor: Hiroaki Tanaka, Nagaokakyo, Japan

[73] Assignee: Murata Mfg., Co. Ltd., Japan

[21] Appl. No.: 582,793

[22] Filed: Sep. 14, 1990

Related U.S. Application Data

[63] Continuation of Ser. No. 398,174, Aug. 24, 1989, abandoned.

[30] Foreign Application Priority Data

Aug. 24, 1988 [JP] Japan ..... 63-210081
Sep. 29, 1988 [JP] Japan ..... 63-127713[U]

[51] Int. Cl.[5] ..... H01P 7/10

[52] U.S. Cl. ..... 333/219.1; 333/228; 333/234

[58] Field of Search ..... 333/219, 219.1, 227–229, 333/234, 235, 202; 331/96, 107 DP, 117 D

[56] References Cited

U.S. PATENT DOCUMENTS 4,706,052 11/1987 Hattori et al. ..... 333/219

FOREIGN PATENT DOCUMENTS 0141803 11/1980 Japan ..... 333/219.1
0212101 9/1986 Japan ..... 333/234
1250720 10/1971 United Kingdom .
1321493 6/1973 United Kingdom .
1376938 12/1974 United Kingdom .
2183928A 6/1987 United Kingdom .
2188789A 10/1987 United Kingdom .

*Primary Examiner*—Eugene R. LaRoche
*Assistant Examiner*—Seung Ham
*Attorney, Agent, or Firm*—Ostrolenk, Faber, Gerb & Soffen

[57] ABSTRACT

A dielectric resonator comprising a dielectric unit which is constructed by piling a plurality of plate-shaped dielectrics one on the other under pressure or adhering dielectrics to each other, so as to prevent an electric field in a resonance mode other than the dominant mode from passing through the faces thereof adhered to each other or brought in contact with each other under pressure, whereby the occurrence of a spurious response can be suppressed.

13 Claims, 5 Drawing Sheets

DIELECTRIC RESONATOR

This is a continuation of application Ser. No. 07/398,174 filed on Aug. 24, 1989 (now abandoned).

BACKGROUND OF THE INVENTION

1. Field of the Invention

The present invention relates to a dielectric resonator for use in, for example, a microwave filter, and more particularly to the improvement of a dielectric block contained in the dielectric resonator.

2. Description of Related Art

Conventionally, in the dielectric resonator of this kind, an arrangement has already been known, for example, as shown in FIG. 14 which is a longitudinal sectional view of a known dielectric resonator to be used in $TE_{01\delta}$ mode, the dielectric resonator comprising a metal-made case 2 which accommodates a cylindrical dielectric body 6 having a through hole in the center thereof and a supporting base 4 made of an insulating material which supports the dielectric body 6.

The case 2 is provided with input/output connectors 8 and loop conductors 10 projecting from the case 2 toward the inside thereof. Thus, the loop conductors 10 and the dielectric body 6 are magnetically connected to each other.

In the dielectric body 6, however, an electromagnetic field is generated in, for example, TM mode in some extent other than an electromagnetic field generated in the dominant resonance mode $TE_{01\delta}$, namely, an electric field distribution perpendicular to the axis 6*z* of the dielectric block and a magnetic field distribution in the direction of the axis 6*z*, thereby to cause a spurious response. In addition, since the dielectric resonator shown in FIG. 14 is comparatively small in its surface area, the heat discharge performance thereof is not favorable. That is, during use, the temperature of the dielectric body 6 rises, with the result that the resonance frequency thereof changes with the change of the dielectric constant thereof or the electrical performance thereof is deteriorated when the dielectric body 6 is used as a filter.

SUMMARY OF THE INVENTION

It is therefore the object of the present invention to provide a dielectric resonator capable of suppressing the generation of a spurious response. Another object of the present invention is to provide a dielectric resonator which is superior in the heat discharge performance and accordingly not deteriorated in the electrical characteristic even though a temperature rises when it is used as a resonator or a filter.

A dielectric unit of a dielectric resonator according to the present invention is constructed by piling a plurality of plate-shaped dielectrics one on the other under pressure or adhering respective dielectrics with an adhesive to each other so that faces thereof to which pressure is applied or faces thereof adhered to each other are parallel with an electric field in the dominant resonance mode of the dielectric resonator. With the above-described construction, since the dielectric unit is constructed by piling the plate-shaped dielectrics one on the other or adhering respective dielectrics to each other, the dielectric constant in the spaces to which pressure is applied or in the spaces in which the adhesive exists is low. Thus, it is difficult for an electric field in a resonance mode other than a dominant resonance mode to pass through the spaces between the faces of the dielectrics to which pressure is applied or the faces thereof adhered to each other. As a result, a spurious response can be suppressed.

In a dielectric resonator in accordance with another embodiment of the present invention, a dielectric unit is accommodated in a conductive case and joined to the conductive case by a supporting member. The feature of the present invention is that the dielectric unit comprises a plurality of first dielectric plates with a relatively high dielectric constant and a plurality of second dielectric plates interposed between the first dielectric plates, respectively, smaller than the first dielectric plates, and having a relatively low dielectric constant. With the above-described construction, almost all of the energy of the electric field in the dielectric unit concentrates on the first dielectric plates having a high dielectric constant. That is, heat is generated by the first dielectric plates. Since the second dielectric plates smaller than the first dielectric plates are disposed as spacers between the first dielectric plates respectively, heat is generated in a wide surface area.

Therefore, according to the present invention, heat is generated in a wide surface area owing to the provision of the second dielectric plates serving as spacers. Thus, the heat discharge performance of the dielectric resonator is favorable.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
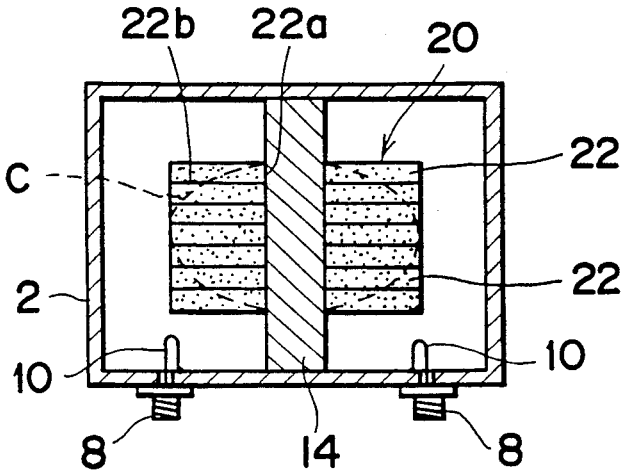
FIG. 1 is a cross-sectional view showing a dielectric resonator in accordance with a first embodiment of the present invention.

Before the description of the present invention proceeds, it is to be noted that like parts are designated by like reference numerals throughout the accompanying drawings.

Figure 2:
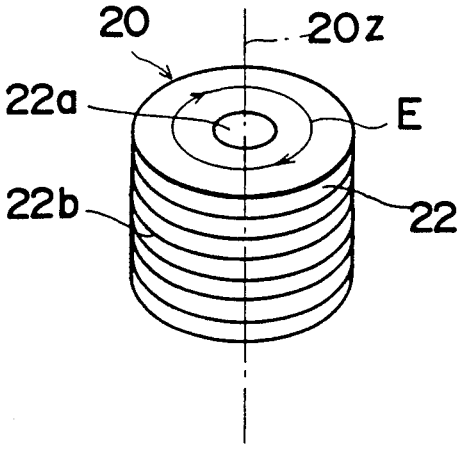
FIG. 2 is a perspective view of the dielectric block of FIG. 1.

Referring now to FIGS. 1 and 2, there shows a dielectric resonator used in $TE_{01\delta}$ mode in accordance with one embodiment of the present invention, which comprises a metal-made case 2, a cylindrical dielectric unit 20 including a plurality of dielectric plates 22 of the same dimensions and provided with a through hole 22*a* in the center thereof, a supporting member 14 made of an insulating material which is fixedly inserted into the through hole 22*a* and mounted at its both ends on the case 2 to support the dielectric unit 20, input/output connectors 8 provided on the case 2, and loop conductors 10 projecting from the case 2 toward the inside thereof.

Figure 14:
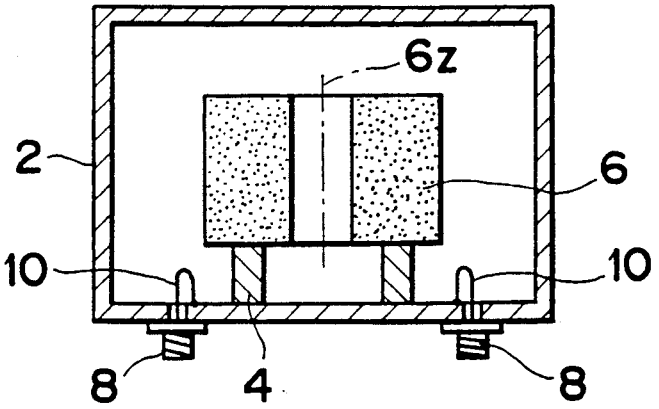
Fig. 14 PRIOR ART
FIG. 14 is a cross-sectional view showing a conventional dielectric resonator, as already referred above.

In this embodiment, the cylindrical dielectric unit 20 of the dielectric resonator corresponding to the dielectric body 6 shown in FIG. 14 is constructed by piling up a plurality of plate-shaped dielectrics 22 under pressure one on the other or adhering respective dielectrics to each other so that faces thereof to which pressure is applied or faces thereof adhered to each other are parallel with an electric field E, as shown in FIG. 2, in a dominant resonance mode, namely, $TE_{01\delta}$ mode of the dielectric resonator.

In this embodiment, each of the dielectric plates 22 has the through hole 22*a* at the center thereof, and the supporting member 14 is penetrating through the holes 22*a*, the dielectric plates 22 being adhered to each other. Thus, the dielectric unit 20 is fixed to the case by means of the supporting member 14 of which both ends are fixed within the case 2. It is preferable that the supporting member 14 is made of material with a low dielectric constant so that the dielectric unit 20 resonates without being given a bad influence.

Any method may be employed to mechanically integrate the dielectrics 22 with each other. As one method, all the dielectrics 22 are adhered to each other with an adhesive. As another method, only the uppermost and lowermost dielectrics 22 are adhered to the supporting member 14 after the supporting member 14 is penetrated therethrough so that these two dielectrics 22 are used to apply pressure to other dielectrics 22 both from top and bottom. As still another method, the supporting member 14 is penetrated through the dielectrics 22 and then two pressure applying plates placed on both the uppermost and lowermost dielectrics 22 are adhered to the supporting member 14, by means of pressure applying member 26 shown in FIG. 3, so that the other dielectrics 22 closely contact with each other under pressure generated by these two pressure applying members 26. The pressure applying members 26 may either be made of a material different from the material of the dielectrics 22, namely, with a low dielectric constant so that the pressure applying members 26 do not prevent the dielectric unit 20 from resonating as it essentially does or may be made of the same material as that of the dielectrics 20. That is, in this case, these pressure applying members 26 constitute part of the dielectric unit 20.

According to the above-described dielectric unit 20 constructed by piling plate-shaped dielectrics 22 one on the other under pressure or adhering the respective dielectrics 22 to each other, the adhesive with a low dielectric constant is interposed in the faces of the dielectrics 22 adhered to each other or air exists in the spaces to which pressure is applied to the faces thereof from top and bottom. Consequently, dielectric constants become inevitably low in the spaces between the faces thereof adhered to each other or in the spaces to which pressure is applied. As a result, it is difficult for an electric field in a resonance mode other than the dominant resonance mode, namely, $TE_{01\delta}$ of the dielectric resonator to pass therethrough. Taking TM mode as an example, the electric field in this mode is directed along the axis 20*z*, as shown in FIG. 2, of the dielectric unit 20, but it is very difficult for the electric field in this mode to pass through the spaces between the faces thereof adhered to each other or the spaces 22*b* to which pressure is applied.

Thus, it is very difficult for an electromagnetic field to be generated in a resonance mode other than the dominant resonance mode. Thus, the occurrence of a spurious response can be suppressed.

Figure 3:
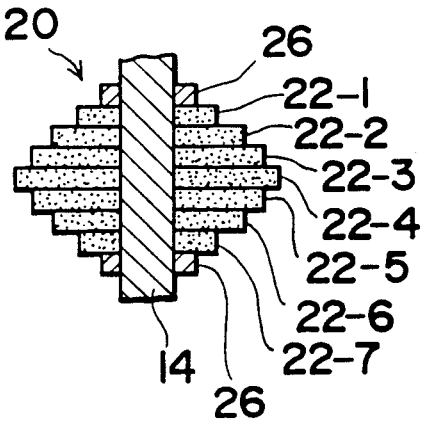
FIGS. 3 through 5 are cross-sectional views showing other examples of dielectric blocks of FIG. 1 respectively.

In the dielectric unit 20, the energy of an electric field in the direction of 20*z* is distributed as shown by broken lines in FIG. 1. As shown in FIG. 1, the energy C of the electric field in the 20*z* direction reaches a peak in the center of the dielectric unit 20 in the horizontal direction thereof. Accordingly, the diameters of the dielectrics 22 constituting the dielectric unit 20 may be varied, i.e., as shown in FIG. 3, similarly to the distribution configuration of the energy of the electric field, the diameters of the dielectrics 22 disposed in the vicinity of the uppermost and lowermost portion of the dielectric unit 20 may be made to be smaller compared with the dielectrics 22 disposed in the center of the dielectric unit 20. This modification of the configuration of the dielectric unit 20 does not bring about a trouble in the operation thereof in the dominant resonance mode.

This construction prevents a resonance from occurring in a mode other than the dominant mode to a greater extent. Further, the dielectric unit 20 can be manufactured with a smaller amount of material, which reduces the weight thereof.

Figure 4:
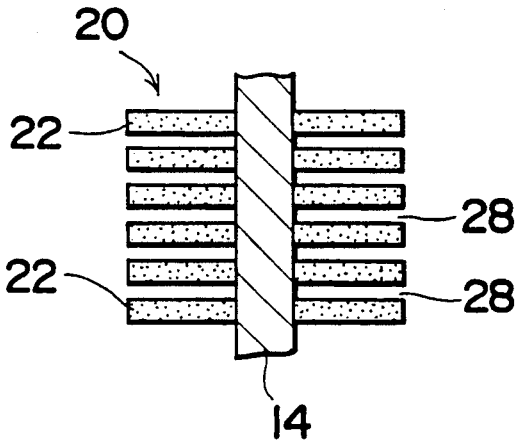
Figure 5:
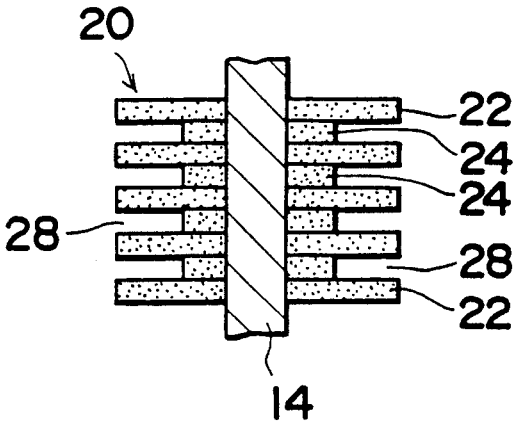

As shown in FIGS. 4 and 5, ring-shaped grooves 28 may be formed between adjacent dielectrics 22 composing the dielectric unit 20. In FIG. 4, the dielectric plates 22 are disposed on the supporting member 14 with providing spaces 28 between pairs of the dielectric plates 22, while in FIG. 5 the small dielectric plates 24 are inserted between pairs of the large dielectric plates 22 to provide the grooves 28 therebetween. It is difficult for an electric field to be generated in the axial direction of the dielectric unit 20. Thus, an occurrence of a resonance in a mode other than the dominant mode can be suppressed to a greater extent. As formed in the above-described examples, the formation of the through hole 22*a* in the dielectric unit 20, namely, an opening in each of the dielectrics 22 composing the dielectric unit 20 is advantageous for suppressing the occurrence of the spurious response, however, the formation of the through hole 22*a* is not essential in constructing the dielectric unit 20.

The dielectric resonator in accordance with the present invention is used not only in the $TE_{01\delta}$ mode, but also in other TE modes, for example, $TE_{01}$ mode, $TE_{11}$ mode and other modified modes thereof. In this case, it is necessary to vary the configuration of the dielectric unit 20 according to a dominant resonance mode used. For example, when the present invention is applied to the $TE_{11}$ mode or a modified mode thereof, it is preferable to use the dielectric unit 20 in the shape of a square pillar.

Figure 6:
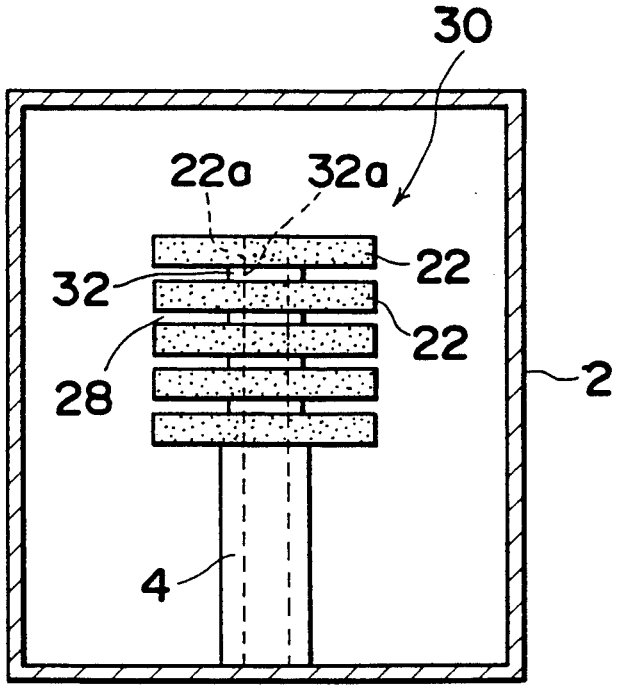
FIG. 6 is a cross-sectional view showing a dielectric resonator of a second embodiment of the present invention.

Referring now to FIG. 6, there is shown another embodiment of a dielectric resonator including a dielectric unit 30 which is accommodated in a conductive case 2 made of conductive material such as a metal or a conductive film formed on the surface of insulating ceramic. The dielectric unit 30 is joined to the conductive case 2 by means of a cylindrical supporting base 4.

The dielectric unit 30 comprises a plurality of first dielectric plates 22 and second dielectric plates 32 interposed between the first dielectric plates 22, respectively.

Each of the first dielectric plates 22 is ring-shaped and has a through hole 22*a* in the center thereof and composed of material with a relatively high dielectric constant. Similarly to the first dielectric plates, each of the second dielectric plates 32 has through hole 32*a* in the center thereof and composed of material with a relatively low dielectric constant. For example, supposing that the dielectric constants of the first dielectric plates are 38, the dielectric constants of the second dielectric plates are 6 to 8. The outer diameters of the second dielectric plates 32 are smaller than those of the first dielectric plates 22 so that large grooves 28 are provided in the respective spaces between adjacent first dielectric plates 22, whereby heat generated by the first dielectric plates 22 piled one on the other can be discharged favorably.

In the dielectric unit 30, 90% or more of the energy of an electric field enclosed therein concentrates on the first dielectric plates 22, because the dielectric constants of which are relatively high. Accordingly, heat is generated mostly by the first dielectric plates 22.

As described above, the second dielectric plates 32 interposed between the adjacent first dielectric plates 22 are smaller in dimension of outer diameters than the first dielectric plates 22. Accordingly, each of the first dielectric plates 22 is exposed in a great extent to the space in which the first dielectric plates 22 are disposed. That is, in this embodiment, heat generated by the first dielectric plates 22 is discharged in a wide surface area, resulting in that the heat discharge performance of the dielectric unit 30 is preferable.

For example, when electric power of 50 W is applied to a dielectric resonator, whose resonance frequency is 1 GHz, constructed based on a conventional dielectric resonator shown in FIG. 14, the temperature thereof rises approximately 30° C whereas in a dielectric resonator provided with the first dielectric plates 22 (five plates) as shown in FIG. 6, the temperature thereof rises as low as approximately 15° C. Thus, the electrical characteristic of the dielectric unit 30 in accordance with this embodiment is not deteriorated even though the temperature thereof rises.

Figure 7:
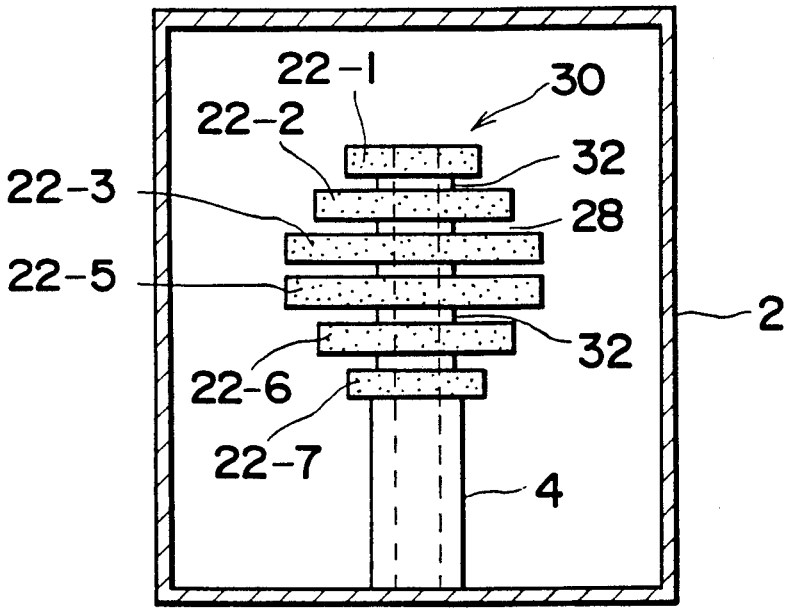
FIG. 7 is a cross-sectional view of another example of dielectric resonator of FIG. 6.

In the embodiment shown in FIG. 6, the sizes of the first dielectric plates 22 are the same, but as shown in FIG. 7, it is possible to construct a dielectric unit 30 in which the sizes of first dielectric plates 22-1 to 22-7 are differentiated and similarly to the dielectric unit 20 shown in FIG. 1, each of the second dielectric plates 32 is interposed between the first dielectric plates 22-1 to 22-7. That is, the first dielectric plates 22 disposed on the upper and lower portions are made smaller than the first dielectric plates 22 disposed in the center portion, whereby the weight of the dielectric unit 30 can be reduced.

Figure 8:
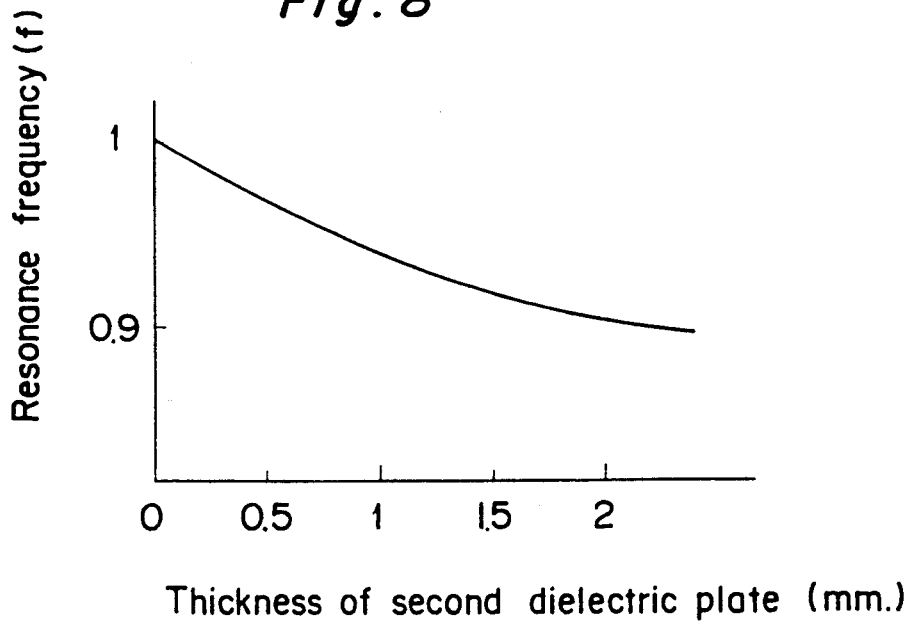
FIG. 8 is a graph showing the change of a resonance frequency obtained when the thickness of a second dielectric plate employed in the dielectric resonator of FIG. 6 is varied.

In the construction of the dielectric unit 30 in accordance with the present invention, the second dielectric plates 32 are used as spacers. Accordingly, the resonance frequency can be controlled by varying the thickness of the second dielectric plates 32 with a low constant. For example, the normalized frequency (f) of the dielectric unit shown in FIG. 8 changes with the thickness changes of the second dielectric plates 32. Thus, an appropriate adjustment of each of the thickness of the second dielectric plates 32 allows the provision of a dielectric resonator having a desired resonance frequency. Any desired number of dielectric units can be used in the above-described embodiments. The dielectric unit can be connected to desired known electric devices. Accordingly, the dielectric resonator of the present invention is constructed by interposing the first dielectric plates of a relatively high dielectric constant between the small second dielectric plates with a low dielectric constant. Therefore, the heat discharge performance of the dielectric resonator is preferable. In other words, the electrical characteristic thereof is not deteriorated even though the temperature thereof rises during use. Furthermore, the variation of the thickness of the second dielectric plates facilitates the control of the resonance frequency. Accordingly, it is possible to obtain a dielectric resonator or a filter having a desired resonance frequency.

Figure 9:
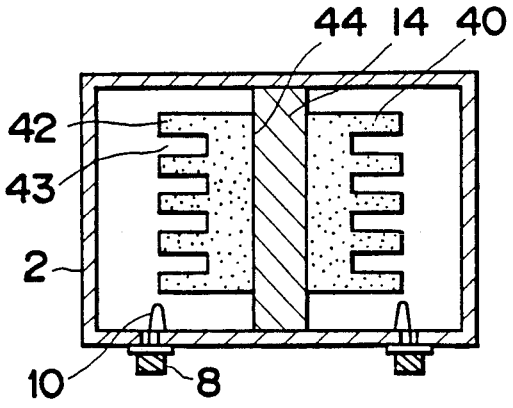
FIG. 9 is a cross-sectional view showing a dielectric resonator of a third embodiment of the present invention.

Referring now to FIG. 9, there is shown the other embodiment of a dielectric resonator having a dielectric block 40 which has the same outer configuration as that of the dielectric unit 20 of FIG. 5, but is integrally formed as one body with projecting portions 42 corresponding to the first dielectric plates 22 and grooves 43 disposed between the projecting portions 42, which correspond to the second dielectric plates 32.

Each of the projecting portions is formed projecting from the body portion of the dielectric block 40 to the outside and located with a space of groove with the others. The dielectric block 40 has a through hole 44 in the center through which a supporting member 14 is inserted, the both ends of the supporting member 14 being fixed within the conductive case 2. In other words, the dielectric block 40 is designed to have a special shape like as a bellows or radiating tube with projecting portion 42 or fines which are effective for the radiation thereof.

Since the whole shape of the dielectric block 40 is resemble to the dielectric unit 20 of FIG. 5, the dielectric block 40 can easily obtain the advantages similar to those of the dielectric unit 20 of FIG. 5 in addition to that the dielectric block 40 can be treated with one unit to make the assembling thereof to the conductive case 2 in simple, the resonance property of the dielectric block 40 is stable under depressing the spurious thereof in the system of TM mode, and the dielectric block 40 is easily manufactured for a short period of time in firing, that is, the shorter of the firing time is more suitable for the production of a large size of the dielectric block 40.

The construction of the dielectric block 40 can be modified in various ways as shown in FIGS. 10 to 13.

Figure 10:
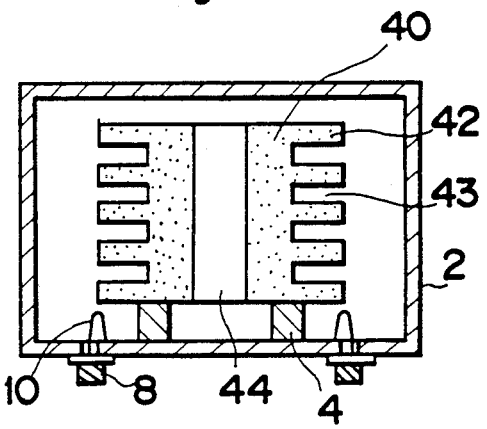
FIGS. 10 through 13 are cross-sectional views showing other examples of dielectric resonators of FIG. 9, respectively.

FIG. 10 shows the dielectric block 40 which is mounted within the conductive case 2 through a supporting base 4 made of an insulating material which is provided between the bottom surface of the dielectric block 40 and the inner lower surface of the conductive case 2.

Figure 11:
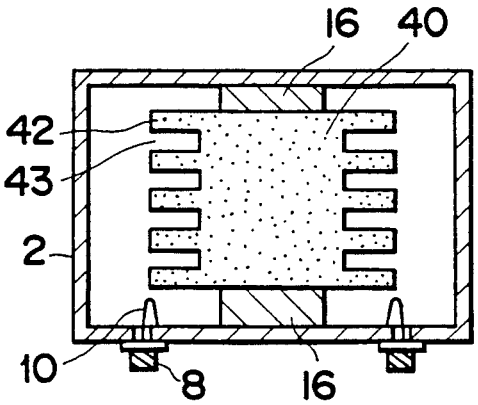
Figure 12:
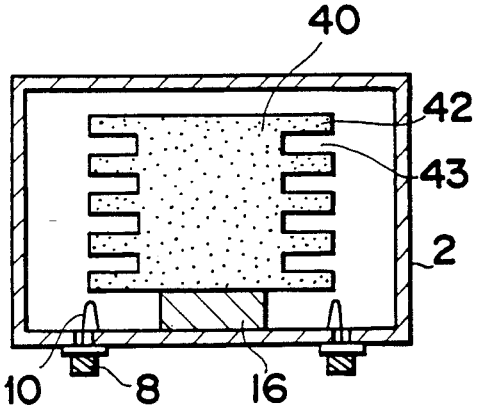

FIGS. 11 and 12 show, respectively, dielectric block 40 modified the dielectric block 40 of FIG. 9 with eliminating the through hole 44 thereof, the dielectric block 4 of FIG. 11 being mounted within the conductive case 2 through a pair of supporting bases 16 which are provided between the top and bottom surface of the dielectric block 40 and the inner upper and lower surfaces of the conductive case 2, while the dielectric block 40 of FIG. 12 is mounted within the conductive case 2 through a supporting base 16 which is provided between the bottom surface of the dielectric block 40 and the inner lower surface of the conductive case 2.

Figure 13:
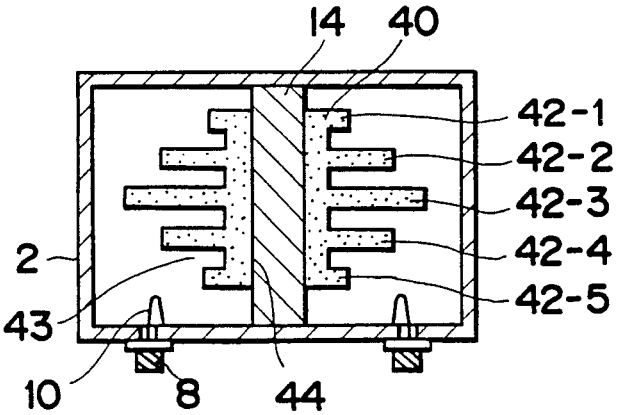

FIG. 13 shows a dielectric block 40 having the outer configuration similar to that of the dielectric unit 30 of FIG. 7, the lengths of the projecting portions 42-1 to 42-5 being varied in such a manner that the lower and upper projecting portions 42 are shorter than the center projecting portions 42 are shorter than the center projecting portion 42 so that the ends of projecting portions 42 are formed in succession of a curved shape like as a drum similar to the configuration of the dielectric unit 20 of FIG. 3, with bringing in the same effect of the dielectric unit 20 of FIG. 3.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dielectric resonator comprising:
a conductive case having a plurality of walls which together define an inner space;
a support member within said inner space and joined to a wall of said conductive case; and
a dielectric resonance unit having a longitudinal axis and a transverse axis perpendicular thereto and including a plurality of dielectric plates mounted on said support member such as to be longitudinally spaced from each other with no other body interposed between said plates and such that said plates are spaced from all of said walls.

2. A dielectric resonator in accordance with claim 1, wherein the respective dimensions of said plates in the direction of the transverse axis are equal to each other.

3. A dielectric resonator in accordance with claim 1, wherein the respective dimensions of said plates in the direction of the transverse axis vary in accordance with the electric field energy of a resonance mode which it is desired to suppress.

4. A dielectric resonator comprising:
a conductive case having a plurality of walls which together define an inner space;
a support member within said inner space and joined to a wall of said conductive case; and
a dielectric resonance unit having a longitudinal axis and a transverse axis and including a plurality of first dielectric plates mounted on said support member in a longitudinally spaced relationship and a plurality of second dielectric plates mounted on said support member in a longitudinally spaced relationship such that said first and second plates are spaced from all of said walls and such that each of said second plates is interposed between successive ones of said first plates, the respective dimensions of said second plates in the direction of the transverse axis being equal and being less than the respective dimensions of said first plates in the direction of the transverse axis.

5. A dielectric resonator in accordance with claim 4, wherein said first and second plates each have the same dielectric constant.

6. A dielectric resonator in accordance with claim 4, wherein each of said first plates has a dielectric constant higher than the dielectric constant of each of said second plates.

7. A dielectric resonator in accordance with claim 4, wherein the respective dimensions of the first plates in the direction of the transverse axis vary in accordance with the electric field energy of a resonance mode which it is desired to suppress.

8. A dielectric resonator comprising:
a conductive case having a plurality of walls which together define an inner space;
a support member within the inner space and joined to a wall of said conductive case; and
a dielectric resonance unit supported by the support member such as to be spaced from all of said walls, said dielectric resonance unit having a longitudinal axis, a transverse axis perpendicular thereto and a plurality of longitudinally spaced projections extending therefrom in the direction of the transverse axis, the respective dimensions of the projections in the direction of the transverse axis varying in accordance with the electric field energy of a resonance mode which it is desired to suppress.

9. A dielectric resonator comprising:
a conductive case having a plurality of walls which together define an inner space;
support means within the inner space and joined to a wall of said conductive case; and
a dielectric resonance unit supported by the support means such as to be spaced from all of said walls, said dielectric resonance unit being a unitary body having a longitudinal axis, a transverse axis perpendicular thereto and a plurality of longitudinally spaced projections extending therefrom in the direction of the transverse axis.

10. A dielectric resonator in accordance with claim 9, in which the dielectric resonance unit has a longitudinal through hole and the support means comprises a post extending through the through hole.

11. A dielectric resonator in accordance with claim 9, in which the dielectric resonance unit has a longitudinal through hole and the support means comprises an annular base interposed between the dielectric unit and a lower wall of the conductive case.

12. A dielectric resonator in accordance with claim 9, in which the support means comprises a base interposed between the dielectric resonance unit and a lower wall of the conductive case.

13. A dielectric resonator in accordance with claim 9, in which the support means includes a second base interposed between the dielectric resonance unit and a upper wall of the conductive case.

* * * * *

UNITED STATES PATENT AND TRADEMARK OFFICE

CERTIFICATE OF CORRECTION

PATENT NO. : 5,059,929

DATED : October 22, 1991

INVENTOR(S) : Hiroaki TANAKA, et al.

It is certified that error appears in the above-identified patent and that said Letters Patent is hereby corrected as shown below:

On the title page, item [75] should read as follows:

[75] Inventors: Toshio Nishikawa, Nagaokakyo, Japan;
Youhei Ishikawa, Kyoto, Japan;
Koichi Takehara, Osaka, Japan;
Hiroaki Tanaka, Nagaokakyo, Japan

Signed and Sealed this

Sixteenth Day of March, 1993

*Attest:*

STEPHEN G. KUNIN

*Attesting Officer*

*Acting Commissioner of Patents and Trademarks*